US011035652B1

(12) United States Patent
Liu

(10) Patent No.: US 11,035,652 B1
(45) Date of Patent: Jun. 15, 2021

(54) MAIN DRIVE ASSEMBLY POSITIONING STRUCTURE FOR THROWING TRAP

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 17/146,586

(22) Filed: Jan. 12, 2021

(51) Int. Cl.
*F41J 9/18* (2006.01)

(52) U.S. Cl.
CPC ..... *F41J 9/18* (2013.01)

(58) Field of Classification Search
CPC ..... F41J 9/18; F41J 9/30
USPC ..... 124/6, 8, 9, 46, 47
See application file for complete search history.

(56) References Cited

U.S. PATENT DOCUMENTS 2,432,155 A * 12/1947 Herold ..... F41J 9/18 124/6
3,225,754 A * 12/1965 Foster ..... F41J 9/30 124/9
3,601,112 A * 8/1971 Dale ..... F41J 9/20 124/8
3,937,203 A * 2/1976 Riedmueller ..... F41J 9/24 124/8
4,014,310 A * 3/1977 Laporte ..... F41J 9/18 124/6
4,300,520 A * 11/1981 Laporte ..... F41J 9/32 124/9
4,481,932 A * 11/1984 Olson ..... F41J 9/20 124/43
4,747,390 A * 5/1988 Storm ..... F41J 9/30 124/47
4,831,996 A * 5/1989 Cero ..... F41J 9/24 124/36
5,249,563 A * 10/1993 Patenaude ..... F41J 9/30 124/46
5,857,451 A * 1/1999 Ciluffo ..... A63B 69/0026 124/6
5,937,839 A * 8/1999 Nilsson ..... F41J 9/30 124/8
5,970,969 A * 10/1999 Anttila ..... F41J 9/30 124/8
6,176,229 B1 * 1/2001 Patenaude ..... F41B 3/04 124/8
6,588,410 B1 * 7/2003 Graber ..... F41J 9/24 124/8
7,263,986 B2 * 9/2007 Lovell ..... F41J 9/24 124/9
8,316,750 B2 * 11/2012 Toeckes ..... A62C 3/0285 89/1.51
8,919,331 B2 * 12/2014 Rennert ..... F41J 9/18 124/8
9,389,050 B1 * 7/2016 Chen ..... F41J 9/30
(Continued)

*Primary Examiner* — Alexander R Niconovich
(74) *Attorney, Agent, or Firm* — Demian K. Jackson; Jackson IPG PLLC

(57) ABSTRACT

A main drive assembly positioning structure for pivotally positioning a main drive assembly on a main frame of a throwing trap by attaching a first fixing frame with a first inner semicircular arc groove and a second fixing frame with a second inner semicircular arc groove to the left and right sides of the main drive assembly and using fastening members to affix the first fixing frame and the second fixing frame together, so that the main drive assembly positioning structure has the advantages of saving accessories and reducing costs and can relatively simplify the installation process and save assembly manpower and man-hours.

2 Claims, 5 Drawing Sheets

(56) References Cited

U.S. PATENT DOCUMENTS

| | | | | |
|---|---|---|---|---|
| 10,365,072 | B1 * | 7/2019 | Liu | F41J 9/32 |
| 10,619,979 | B2 * | 4/2020 | Francez | F41J 9/18 |
| 10,859,349 | B1 * | 12/2020 | Liu | F41J 9/18 |

* cited by examiner

MAIN DRIVE ASSEMBLY POSITIONING STRUCTURE FOR THROWING TRAP

BACKGROUND AND SUMMARY OF THE INVENTION

The present invention relates to throwing trap technology and more particularly, to a main drive assembly positioning structure, which enables the main drive assembly of the throwing trap to be pivoted and positioned through a first fixing frame and a second fixing frame, so that the main drive assembly positioning structure has the advantages of saving accessories and reducing costs.

The bearing seat 7 (see FIG. 2) of the throwing arm drive spindle 61 of the conventional throwing trap 6 (see FIGS. 1 and 2) is manufactured by the processing of a lathe, milling machine, or CNC machine. The bearing seat 7 thus processed needs to be mounted with first and second bearings 62 and 63 through a hydraulic machine (not shown), and then the throwing arm drive spindle 61 is installed into the bearing seat 7 through the hydraulic machine. Then a prive plate 64 is welded under the throwing arm drive spindle 61, and then a sprocket 65 is installed in the throwing arm drive spindle 61. Further assemble an upper fixing frame 8 on the throwing arm drive spindle 61, then weld an arm mounting plate 68 on the top of the throwing arm drive spindle 61, and then use four screws 93 to fastened four fixing holes (not shown) of the bearing seat 7 to a lower fixing frame 9 that is fixed above the main frame 60 by a combination of four sets of screws 91 and nuts 92, and the four sets of screws 94 and nuts 95 are used to fasten the four fixing holes 81 of the upper fixing frame 8 to the main frame 60 to complete the installation operation. However, this mounting structure has the following drawbacks:

1. There are many accessories, such as the upper fixing frame 8, the lower fixing frame 9, and the bearing seat 7, and the manufacturing cost is relatively high.

2. Not only there are more accessories and the installation procedure is cumbersome, it is relatively wasteful of manpower and assembly costs.

The present invention has been accomplished under the circumstances in view. It is therefore the main object of the present invention to provide a main drive assembly positioning structure for throwing trap, which is so configured that the main drive assembly of the throwing trap can be pivoted and positioned through a first fixing frame and a second fixing frame, so that the main drive assembly positioning structure has the advantages of saving accessories (for example, the upper fixing frame, bearing seat and lower fixing frame can be relatively saved) and reducing costs.

It is another object of the present invention to provide a main drive assembly positioning structure for throwing trap, which can relatively simplify the installation process and save assembly manpower and man-hours.

DETAILED DESCRIPTION OF THE INVENTION

Figure 1:
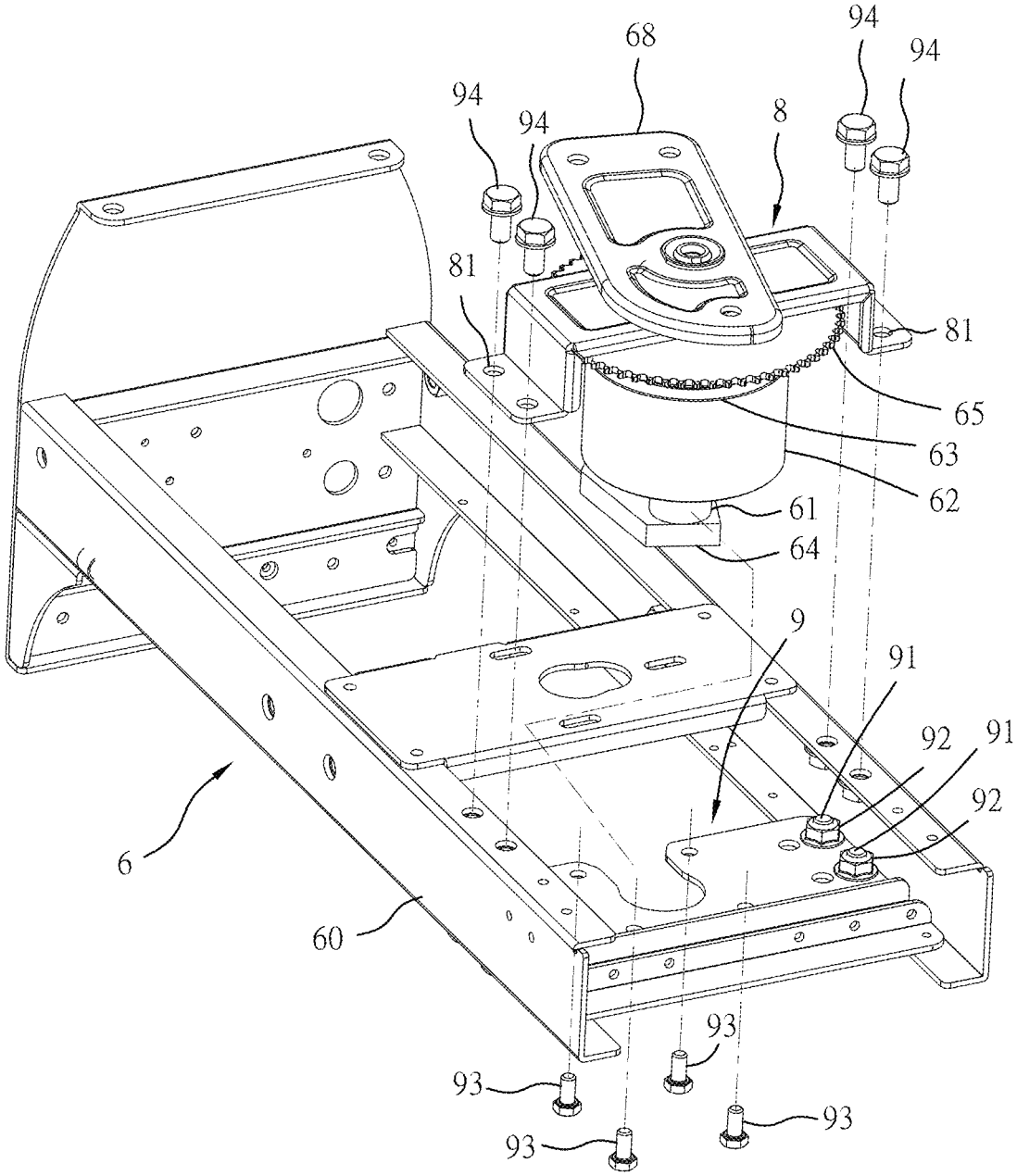
Fig. 1 PRIOR ART
FIG. 1 is an exploded view of a part of a conventional throwing trap.
Figure 2:
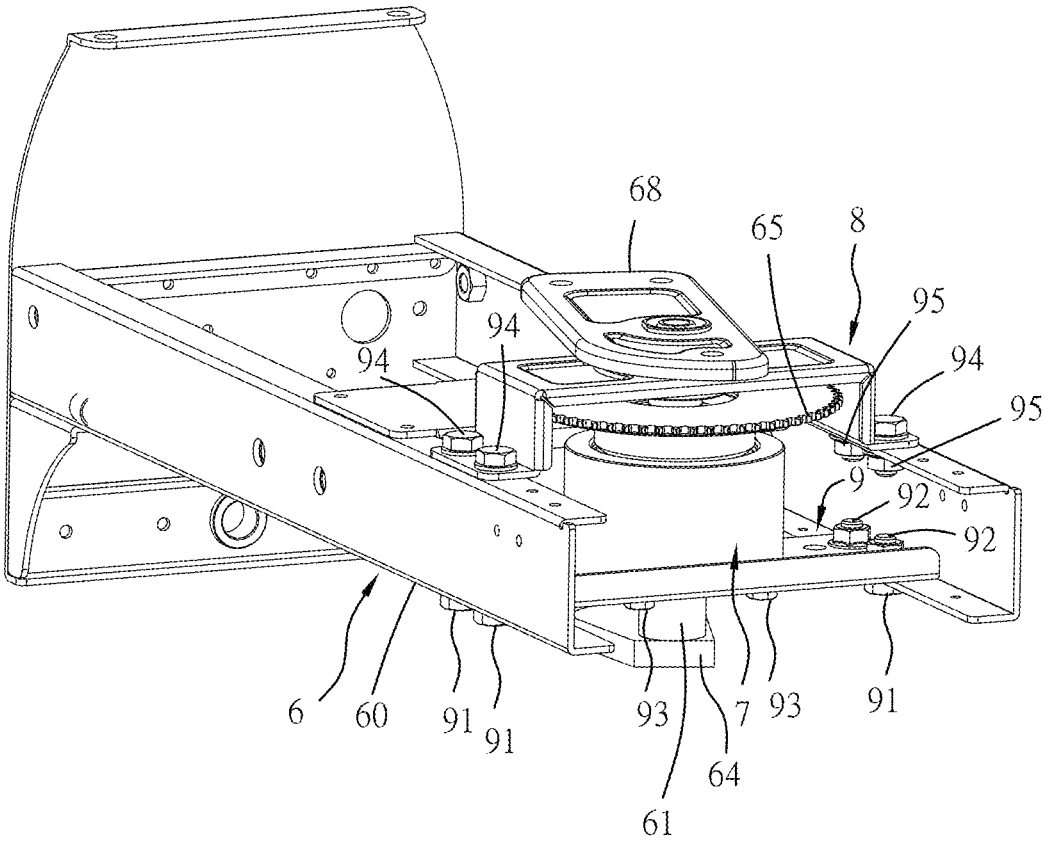
Fig. 2 PRIOR ART
FIG. 2 is an elevational assembly view of the conventional throwing trap shown in FIG. 1.
Figure 3:
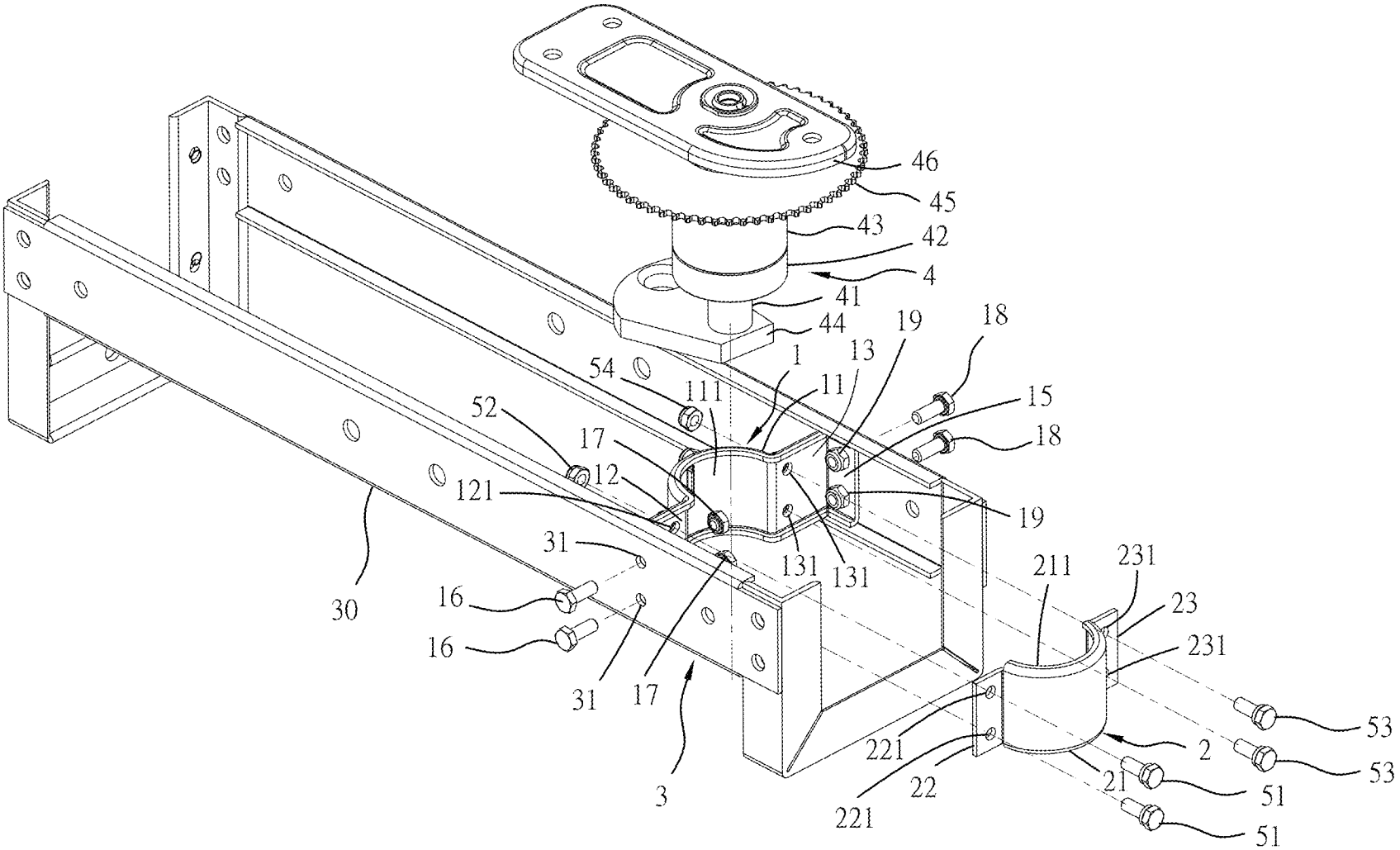
FIG. 3 is an exploded view of the present invention.
Figure 4:
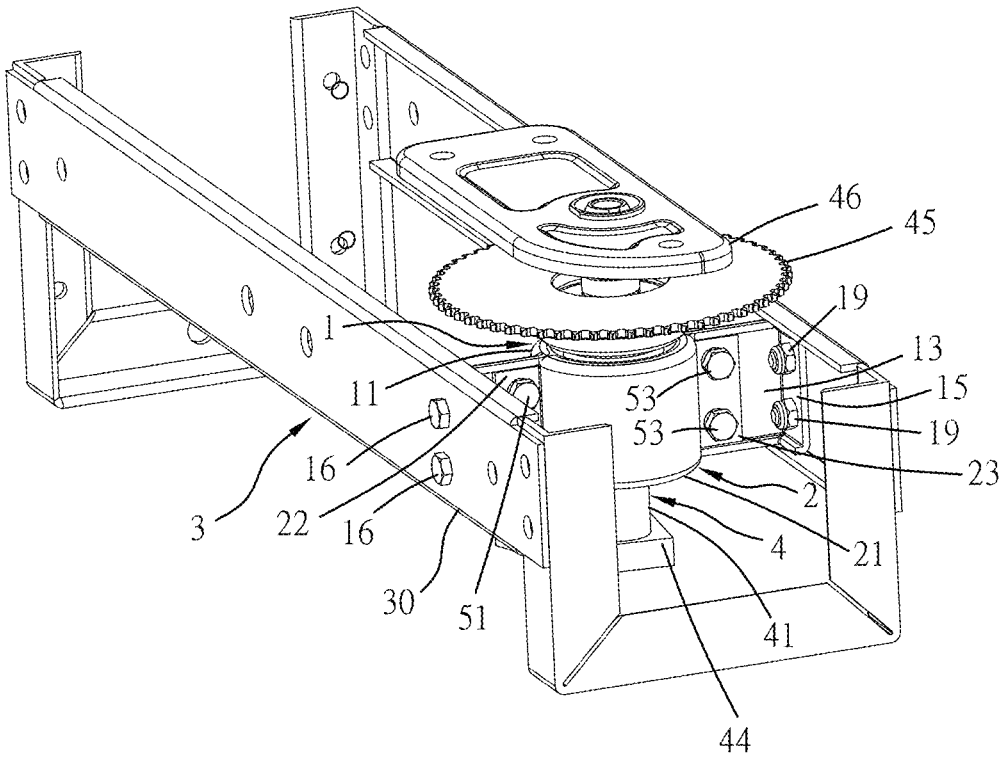
FIG. 4 is an elevational assembly view of FIG. 3.

Referring to FIGS. 3 and 4, a main drive assembly positioning structure is used in a throwing trap 3 to pivotally position a main drive assembly 4 on a main frame 30 of the throwing trap 3. The main drive assembly 4 comprises a throwing arm drive spindle 41, a first bearing 42 and a second bearing 43 assembled on the throwing arm drive spindle 41, a prive plate 44 welded to the bottom end of the throwing arm drive spindle 41, a sprocket 45 assembled on the throwing arm drive spindle 41 above the first bearing 42 and the second bearing 43, an arm mounting plate 46 welded to the opposing top end of the throwing arm drive spindle 41, and a throwing arm mounted on the top side of the arm mounting plate 46. When the sprocket 45 of the main drive assembly 4 is driven to rotate, the throwing arm drive spindle 41 is relatively driven to rotate, so that the throwing arm rotates accordingly, and the clay (not shown) placed on the throwing arm is thrown out by centrifugal force.

The main drive assembly positioning structure comprises a first fixing frame 1 and a second fixing frame 2.

Figure 5:
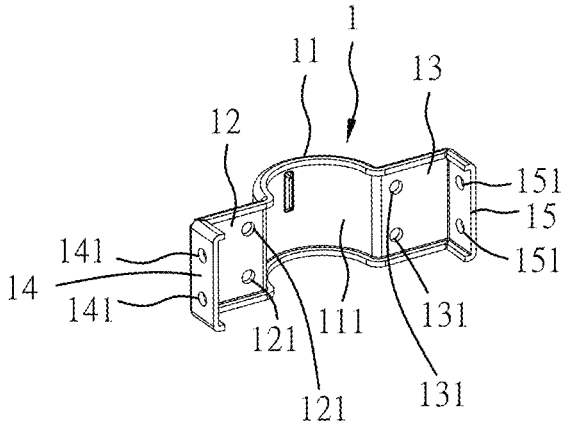
FIG. 5 is an elevational view of the first fixing member.

The first fixing frame 1 (see FIGS. 3-5) comprises a first positioning portion 11, a first left connection wall 12 and a first right connection wall 13 respectively connected to the opposing left and right sides of the first positioning portion 11, a left fixing wall 14 (see FIG. 5) perpendicularly connected to the first left connection wall 12, a right fixing wall 15 perpendicularly connected to the first right connection wall 13, a first inner semicircular arc groove 111 defined by the first positioning portion 11, at least one first left connection hole 121 (see FIG. 5) located on the first left connection wall 12, at least one first right connection hole 131 (see FIG. 5) located on the first right connection wall 13, at least one first fixing hole 141 (see FIG. 5) located on the left fixing wall 14, at least one second fixing hole 151 (see FIG. 5) located on the right fixing wall 15, and first and second left fastening members 16,17 (see FIG. 3) and first and second right fastening members 18,19 respectively mounted in the at least one first left connection hole 121, the at least one first right connection hole 131, the at least one first fixing hole 141 and the at least one second fixing hole 151 and fastened to respective third fixing holes 31 (FIG. 3) on the left and right sides of the main frame 30 to fix the first fixing frame 1 to the main frame 30 and to keep the left fixing wall 14 and the right fixing wall 15 be attached to the left and right sides of the main frame 30 respectively. Alternatively, the left fixing wall 14 and the right fixing wall 15 can be directly welded to the left and right sides of the main frame 30.

The second fixing frame 2 (see FIGS. 3 and 4) comprises a second positioning portion 21, a second left connection wall 22 and a second right connection wall 23 respectively connected to the opposing left and right sides of the second positioning portion 21, a second inner semicircular arc groove 211 defined by the second positioning portion 21, at least one second left connection hole 221 located on the second left connection wall 22, at least one second right connection hole 231 located on the second right connection wall 23, at least one first fastening member 51 and at least one second fastening member 52 (see FIG. 3) for fastening the at least one second left connection hole 221 to the at least one first left connection hole 121 of the first left connection wall 12 of the first fixing frame 1, and at least one third fastening member 53 and at least one fourth fastening member 54 (see FIG. 3) for fastening the at least one second right connection hole 231 to the at least one first right connection hole 131 of the first right connection wall 13 of the first fixing frame 1.

In this way, when you want to install, first assemble the throwing arm drive spindle 41 with the first bearing 42 and the second bearing 43, then weld the prive plate 44 to the bottom end of the throwing arm drive spindle 41. After assembling the sprocket 45 above the throwing arm drive spindle 41 and welding the arm mounting plate 46, the assembly of the main drive assembly 4 is completed. Then one side of the second bearing 43 of the main drive assembly 4 can be pressed against the first inner semicircular arc groove 111 of the first positioning portion 11 of the first fixing frame 1, and then the second inner semicircular arc groove 211 of the second positioning portion 21 of the second fixing frame 2 can be abutted against the other side of the second bearing 43. Thereafter, the at least one first fastening member 51 and the at least one second fastening member 52 are used to fasten the at least one second left connection hole 221 to the at least one first left connection hole 121 of the first left connection wall 12 of the first fixing frame 1 and the at least one third fastening member 53 and the at least one fourth fastening member 54 are used to fasten the at least one second right connection hole 231 to the first right connection hole 131 of the first right connection wall 13 of the first fixing frame 1 to pivotally position the main drive assembly 4 between the first positioning portion 11 of the first fixing frame 1 and the second positioning portion 21 of the second fixing frame 2.

Furthermore, the aforementioned first fixing frame 1 is made of rigid metal material or rigid plastic material, and the aforementioned second fixing frame 2 is made of rigid metal material or rigid plastic material.

In summary, the invention of the present invention can be summarized as having the following enhancement effects:

1. The main drive assembly 4 of the throwing trap 3 can be pivoted and positioned through the first fixing frame 1 and the second fixing frame 2. At the same time, it has the advantages of saving accessories (for example, the upper fixing frame, bearing seat and lower fixing frame can be relatively saved) and reducing costs.

2. It can relatively simplify the installation process and save assembly manpower and man-hours.

What is claimed is:

1. A main drive assembly positioning structure used in a throwing trap to pivotally position a main drive assembly on a main frame of said throwing trap, said main drive assembly comprising a throwing arm drive spindle, a first bearing and a second bearing assembled on said throwing arm drive spindle, a prive plate welded to a bottom end of said throwing arm drive spindle, a sprocket assembled on said throwing arm drive spindle above said first bearing and said second bearing, an arm mounting plate welded to an opposing top end of said throwing arm drive spindle and a throwing arm mounted on a top side of said arm mounting plate, the main drive assembly positioning structure comprising:

a first fixing frame comprising a first positioning portion, a first left connection wall and a first right connection wall respectively connected to opposing left and right sides of said first positioning portion, a left fixing wall perpendicularly connected to said first left connection wall, a right fixing wall perpendicularly connected to said first right connection wall, a first inner semicircular arc groove defined by said first positioning portion, at least one first left connection hole located on said first left connection wall and at least one first right connection hole located on said first right connection wall, said left fixing wall and said right fixing wall being used to fix opposing left and right sides of said main frame respectively; and a second fixing frame comprising a second positioning portion, a second left connection wall and a second right connection wall respectively connected to opposing left and right sides of said second positioning portion, a second inner semicircular arc groove defined by said second positioning portion, at least one second left connection hole located on said second left connection wall, at least one second right connection hole located on said second right connection wall, at least one first fastening member and at least one second fastening member for fastening said at least one second left connection hole to said at least one first left connection hole of said first left connection wall of said first fixing frame and at least one third fastening member and at least one fourth fastening member for fastening said at least one second right connection hole to said at least one first right connection hole of said first right connection wall of said first fixing frame.

2. The main drive assembly positioning structure as claimed in claim 1, wherein said first fixing frame is selectively made of rigid metal material or rigid plastic material; said second fixing frame is electively made of rigid metal material or rigid plastic material.

* * * * *